US007004319B2

(12) United States Patent
Knight et al.

(10) Patent No.: US 7,004,319 B2
(45) Date of Patent: Feb. 28, 2006

(54) LIGHT STRING STORAGE DEVICE AND TURNTABLE

(76) Inventors: Roy F. Knight, P.O. Box 1516, Norman, OK (US) 73070; Beverly Jane Knight, P.O. Box 1516, Norman, OK (US) 73070; R. Michael Ruckel, 10404 Condor Ter., Oklahoma City, OK (US) 73162; R. William Graham, 8350 Innsbrook La., Dayton, OH (US) 45066

( * ) Notice: Subject to any disclaimer, the term of this patent is extended or adjusted under 35 U.S.C. 154(b) by 344 days.

(21) Appl. No.: 10/382,664

(22) Filed: Mar. 6, 2003

(65) Prior Publication Data

US 2004/0173489 A1 Sep. 9, 2004

(51) Int. Cl.
*B65D 85/42* (2006.01)

(52) U.S. Cl. ..... 206/420; 206/419

(58) Field of Classification Search ..... 206/388, 206/418–422, 575, 702; 211/60.1, 70, 78, 211/95, 163; 223/106, 107; 242/402, 405.1, 242/405.2, 406, 407
See application file for complete search history.

(56) References Cited

U.S. PATENT DOCUMENTS

| | | | | |
|---|---|---|---|---|
| 2,872,032 | A | | 2/1959 | West |
| 2,984,347 | A | | 5/1961 | Kalinchuk |
| 3,384,227 | A | | 5/1968 | Spatz |
| 3,878,941 | A | | 4/1975 | Kelner |
| 3,931,887 | A | | 1/1976 | Beck |
| 4,022,323 | A | | 5/1977 | Yamazaki |
| 4,029,241 | A | | 6/1977 | Krake |
| 4,917,323 | A | | 4/1990 | Wing |
| 4,979,085 | A | | 12/1990 | Voorhees |
| 5,033,619 | A | | 7/1991 | Garis |
| 5,064,067 | A | | 11/1991 | McAllister et al. |
| 5,287,965 | A | | 2/1994 | Miller |
| 5,317,491 | A | | 5/1994 | Lee |
| 5,381,899 | A | | 1/1995 | Rabbit |
| 5,480,036 | A | | 1/1996 | Opar |
| 5,482,226 | A | | 1/1996 | Choate |
| 5,526,931 | A | | 6/1996 | White |
| 5,641,075 | A | * | 6/1997 | Mechlin ..... 211/26 |
| 5,907,945 | A | | 6/1999 | Doyle |
| 5,924,570 | A | | 7/1999 | Sickles |
| 5,957,401 | A | * | 9/1999 | O'Donnell ..... 242/404.3 |
| 6,142,314 | A | | 11/2000 | Cotterill |
| 6,398,148 | B1 | | 6/2002 | Snow |
| 6,431,489 | B1 | | 8/2002 | Rose |
| 6,467,623 | B1 | | 10/2002 | Lewis et al. |

* cited by examiner

*Primary Examiner*—Kurt Fernstrom
(74) *Attorney, Agent, or Firm*—R. William Graham

(57) ABSTRACT

The present invention is a light string storage device that is used to easily wind and un-wind light strings, such as Christmas lights, and is used for storage of the strands. The device protects the light bulbs and sockets against damage; the electric cord, plug and connector and light bulbs stay in place and untangled; it keeps the cord and bulbs from twisting as they are placed on the device; and the plug and connectors are easily attainable for testing the lights prior to strand placement. The invention also includes a turntable with retaining means to easily attach and remove the storage device to the turntable. The lightweight turntable can either sit on the ground or table during use and allows the person to turn the storage device easily during installing or removing of the light strands.

11 Claims, 7 Drawing Sheets

LIGHT STRING STORAGE DEVICE AND TURNTABLE

BACKGROUND OF THE INVENTION

1. Field of the Invention

The present invention relates to a light string storage device. More particular, the invention relates to rolling up an electric cord having attached sockets and light bulbs with cord ends having a plug and a connector in a manner to protect the light bulbs and store the light string after use, such as in the case of Christmas tree lights. The invention also includes a turntable with a retainer to easily attach and remove the storage device to the turntable. The lightweight turntable can either sit on the ground or table during use and allows the person to turn the storage device easily during installing or removing the light strands.

2. Related Art

It is of some importance to discuss the background of the light string storage device to gain a better understanding and best appreciate the invention. Every year people all over the world perform the tedious, time consuming and frustrating task of untangling and hanging Christmas lights. Then, after the season is over, the light strings must either be: 1) rolled up, packaged and stored in boxes or bags hoping the strands will be easily untangled and the fragile bulbs are not broken the next year or 2) thrown away.

In the past, the light string storage devices that existed in the prior art have either failed to minimize the tangling of light strings, keep the wire and bulbs from twisting as they are placed on the reel, protect the wire, plugs and connectors and light bulbs and/or provide a convenient and economic method for their storage.

Blot's Canadian Patent #2,083,292 for Holder for a String of Lights includes the disclosure of suspendable decorative light carrying devices.

Garis's U.S. Pat. No. 5,033,619 that relates to a light string carrier including a lattice comprising a plurality of parallel elongated rectangular plates, around which light strings may be wrapped. The lattice is stored within two hingedly engaging covers, one of which has a handle thereon.

McAllister's, et al., U.S. Pat. No. 5,064,067 that discloses a generally rectangular frame around which a light string can be wound, with tooth-like projections at the edges of the frame to prevent the wire from slipping.

Lee's U.S. Pat. No. 5,317,491 that discloses a flat, stiff mounting plate with integrated, uniformly-spaced slotted labs, allowing for the light string wire to be wound around the plate and the lights to be inserted into the slots.

Rabbitt's, U.S. Pat. No. 5,381,899 discloses a light packaging device for viewing, testing, and eventual retail sale of light strings.

Spatz's, U.S. Pat. No. 3,384,227 discloses a Christmas Tree Lights Storage Container comprising an elongated horizontally extending rectangular hollow box sealed at one end and open at the other.

White's U.S. Pat. No. 5,526,931 that discloses a slotted base card with swivel-pivots, so that the card may be axially rotated to wind and un-wind the light string on the card.

West's U.S. Pat. No. 2,872,032 discloses a device that has a cylinder type shape and holes for the bulbs, but it is not a practicle product as described. This device does not work for the placement of the last end of the light string (plug or connector) to be rolled and also does not cover the use for curtain light sets or web light sets.

The above mentioned prior art all have their short comings, but are overcome by the present invention. It will be apparent that a need exists for an improved light string storage device.

SUMMARY OF THE INVENTION

It is an object of the present invention to enhance the ease of winding and un-winding of holiday light strings and their storage.

It is another object of the present invention to provide a device that can be used to store the many kinds of light strands:and accommodate the varied bulb sizes and distances (spaced intervals) between bulbs, as well as the various lengths of electrical wire with plugs and connectors.

It is an object of the present invention to provide a storage device which can be used as a free-standing rack or be hand held and is lightweight.

It is yet another object of the present invention to protect the wiring, bulbs, bulb sockets, and provide a secure holder for the plug and connector of the light string, so that the ends of the strand do not become tangled and may be easily located for testing of the light string before use.

It is still another object of the present invention to provide a device that can accommodate multiple strings of lights on a single product and keep the cord and bulbs from twisting as they are placed on the device.

It is an important object of the present invention to provide a device that is highly engineered, which is of simplified construction, durable, made of sturdy reliable materials and conveniently re-useable.

It is a further object of the present invention to produce a product that is easily and efficiently made at a low cost to the manufacturer and marketed at an economic price to the consumer.

It is still a further object of the present invention to provide a product device which may be marketed in a stackable or flat state, for easy packaging, shipping and transporting.

It is another object of the present invention to provide a device which may be assembled for use without tools, few moving parts, with the least amount of effort or instruction.

It is further a more important object of the present invention that provides advantages over prior art.

It is another important object of the present invention to provide a turntable with a retainer to easily attach and remove the storage device to the turntable.

The light string storage device in accordance with the present invention enhances and overcomes the limitations of prior art by the following: 1) ease of winding and un-winding the strand from the storage device; 2) used to store the many kinds of light strands; 3) accommodate the varied bulb sizes and distance between bulbs; 4) used for various lengths of electrical wire with different plugs and connectors; 5) reduces tangling of the cord and bulbs; 6) keeps the cord and bulbs from twisting as they are placed on the device; 7) protects the wiring, bulbs and bulb sockets; 8) provides a secure holder for the plug and connector of the light string; 9) access to the plug for testing of the light string prior to use; 10) can accommodate multiple strings of lights on a single rack; 11) used as a free-standing rack or is hand held; 12) a device that is highly engineered, well constructed, durable and made of sturdy reliable materials; 13) a device that is easily and efficiently made at a low cost to the manufacturer and marketed at an economic price to the consumer; 14) a device that is marketed in a stackable or flat state, for easy packaging, shipping and transporting; 15)

assembled without tools with few moving parts and with the feast amount of effort or instruction; and 16) providing a turntable with a retainer to attach the light string storage device. The turntable can either sit on the ground or table and allows the person to turn the storage device easily during installing or removing the light strands.

Accordingly, provided is a Christmas light storage device for storing a plurality of lights electrically connected by a wire to one another in a predetermined spaced pattern. The device includes a tubular member having a plurality of open surfaces circumferentially spaced about the tubular member in a manner to receive one of the a lights as the wire is wrapped about the tubular member and each open surface includes a radially extending wire receiving slot which is of a size to receive the wire in a friction fit manner.

Another embodiment is directed to a Christmas light storage device for storing a plurality of lights electrically connected by a wire to one another in a predetermined spaced pattern having a length and a width and in the form of one of a net and strand design. This design includes a tubular member having length slightly longer than at least one of the width and length of the light, and having a plurality of circumferentially spaced wire receiving slots formed in a first end of said tubular member which are of a size to receive the wire in a friction fit manner such that the lights can be wrapped about the tubular member in a manner such that the light pattern as it is wrapped rests along a surface of the tubular member.

A further embodiment is directed to a Christmas light storage device that includes a turntable with a retainer to attach the light string storage device. The turntable can either sit on the ground or table and allows the person to turn the storage device easily during installing or removing the light strands.

Thus, it is evident that the Light String Storage Device for storing strands of lights of the present invention provides a substantial advancement in the art. Other objects and advantages will be readily apparent to those skilled in the art upon viewing the drawings and reading the detailed description hereafter.

DETAILED DESCRIPTION

Figure 1A:
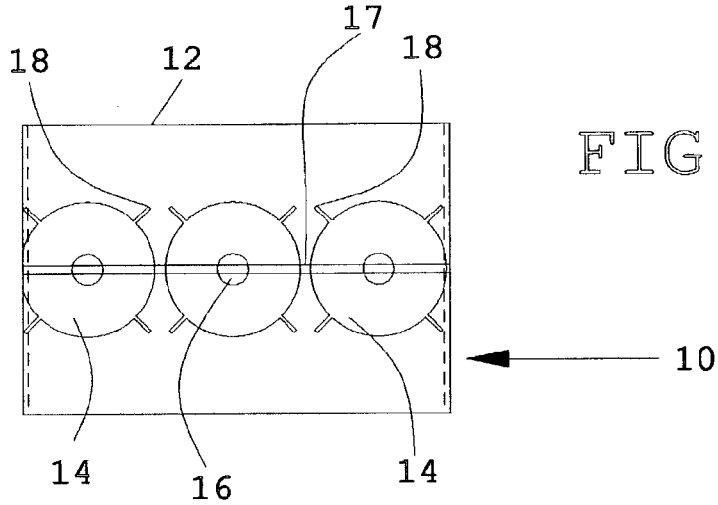
FIG. 1A is a side view showing the Light String Storage device constructed for a light strand in accordance with the present invention.

Referring now to the drawings, the light string storage device of the invention is generally depicted by the numerals 10, 10", 100, 100', 100", 200 and 500. Turning to the embodiment of FIGS. 1A and 4, the device 10 includes a generally cylindrical member 12 which can be made of a plastic material in a pipe form, for example.

Figure 4:
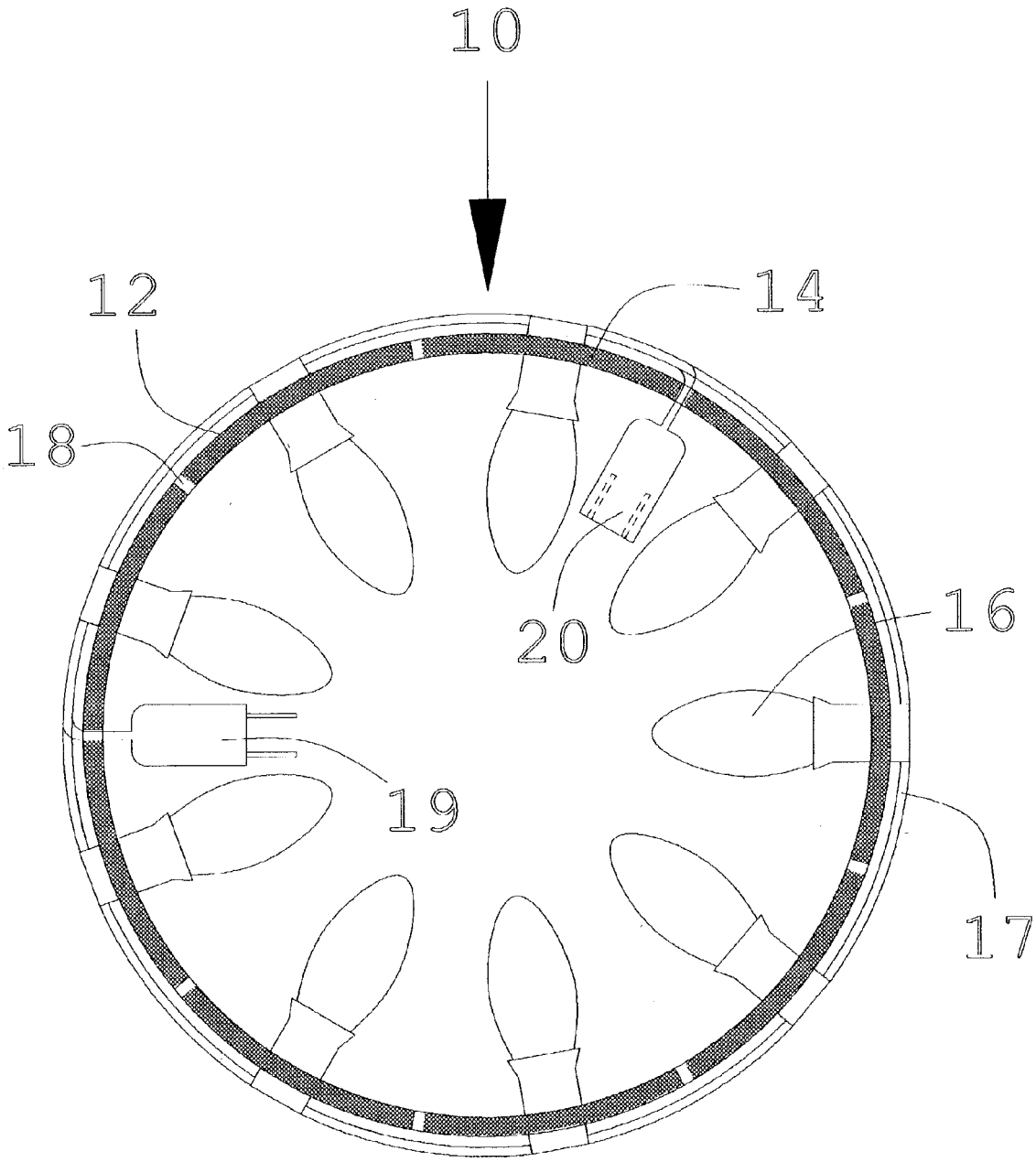
FIG. 4 is an end view showing the Light String Storage device with a light strand thereon and light bulbs disposed inside the device.

The member 12 has a plurality of open surfaces 14 circumferentially spaced about the member 12 in a manner to receive lights 16 on a wire 17 is wrapped about the member 12 and each open surface 14 includes a plurality, such as four, radially extending wire receiving slots 18 which are of a size to receive the wire 17 in a friction fit manner. In this way, the wire and 17 can be attached at any number of points along the perimeter of the member 12. As seen in FIG. 4, the wire 17 has an end male plug 19 and female end connector 20, wherein one end can be inserted into any one of the open surfaces 14 with the wire 17 frictionally fit into the wire receiving slot 18. This permits the remaining portion of the wire 17 and its connected bulbs 16 to hold with one hand and easily guide the bulbs 16 into the open surfaces as one's other hand rotates or positions the member 12. As part of the design of the device 10, when the other end of the wire 17 can be inserted into any one of the coinciding open surfaces 14 and likewise attached to a wire receiving slot 18 therein thus fixing the wire 17 in a tightly wound manner and permitting ease of removal upon next use.

Figure 1B:
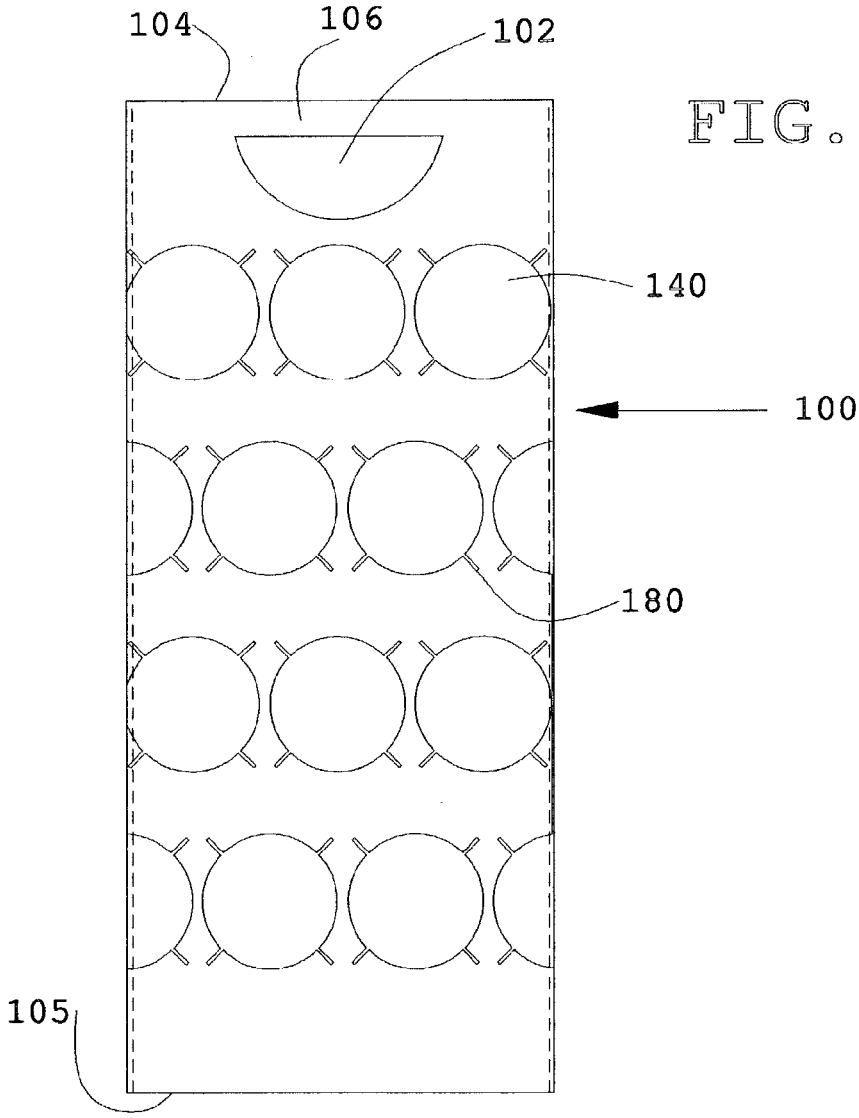
FIG. 1B is a side view showing the Light String Storage device constructed for a plurality of light strands in accordance with the present invention.

FIG. 1A depicts a single row of open surfaces while FIG. 1B depicts a plurality of rows of open surfaces 140 and associated wire receiving slots 180 in a generally tubular device 100. This enables multiple strands of various lights to be quickly and readily stored on one unit. Further, an end of the device 100 includes another open surface 102 which serves as a handle to aid in carrying the device 100 once the lights are stored thereon. The open surface 102 is disposed near a top end 104 so that a portion 106 serves as the handle in which to grasp and move the device 100.

Figure 2B:
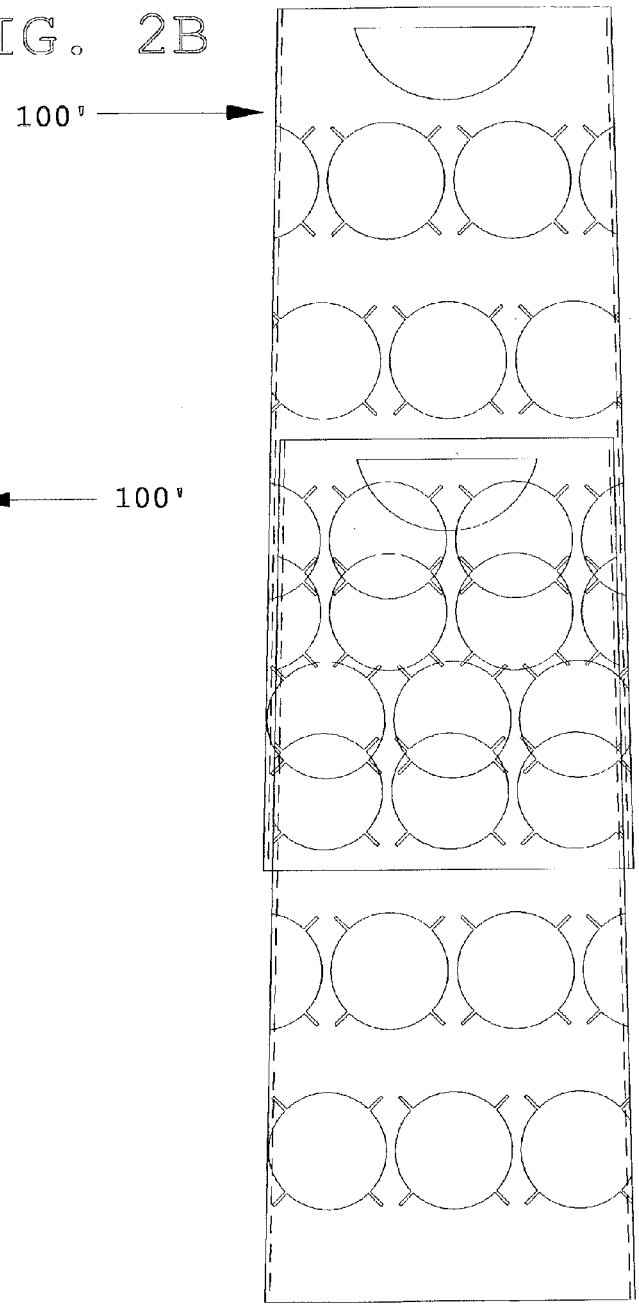
FIG. 2B depicts the Light String Storage device of FIG. 2A in a stacked manner.
Figure 2A:
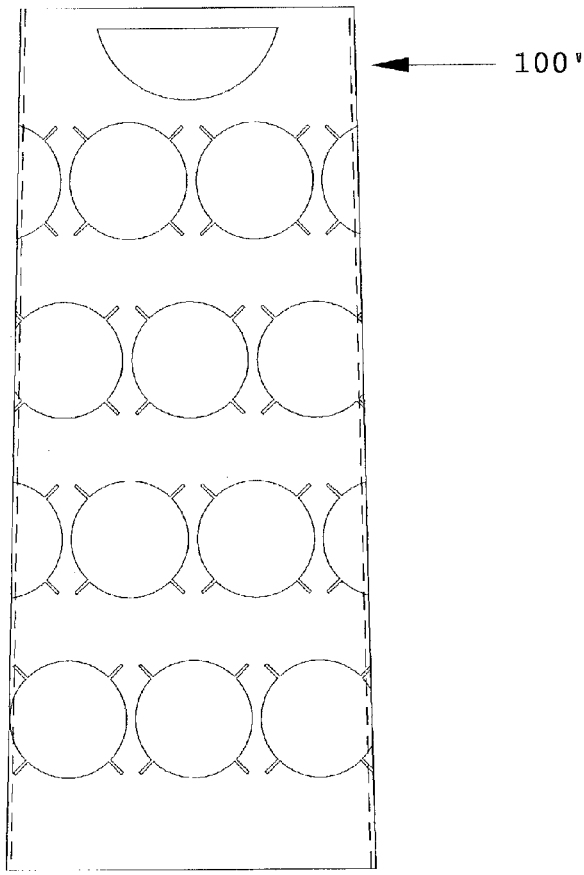
FIG. 2A depicts a side view showing another embodiment of the Light String Storage device constructed with an separate area for multiple strands and is stackable.

FIGS. 2A and 2B show a modified version of the device 100'. Here, the device 100' differs from device 100 in that it is slightly tapered from one end to the other, thus forming a frustoconical shape. Thus, the device 100' provides the ability to nest in with like formed devices 100' as seen in FIG. 2B.

Figure 3A:
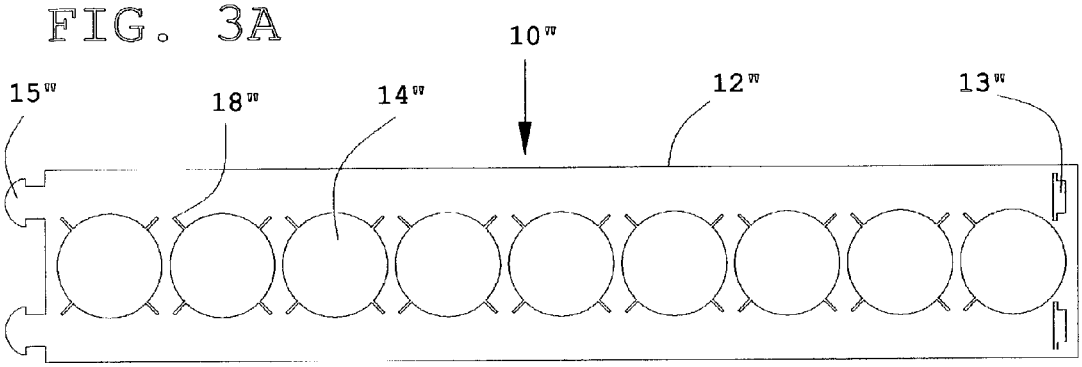
FIG. 3A is a side view showing another embodiment of the Light String Storage device constructed for a strand and which is in an unassembled flat state.
Figure 3B:
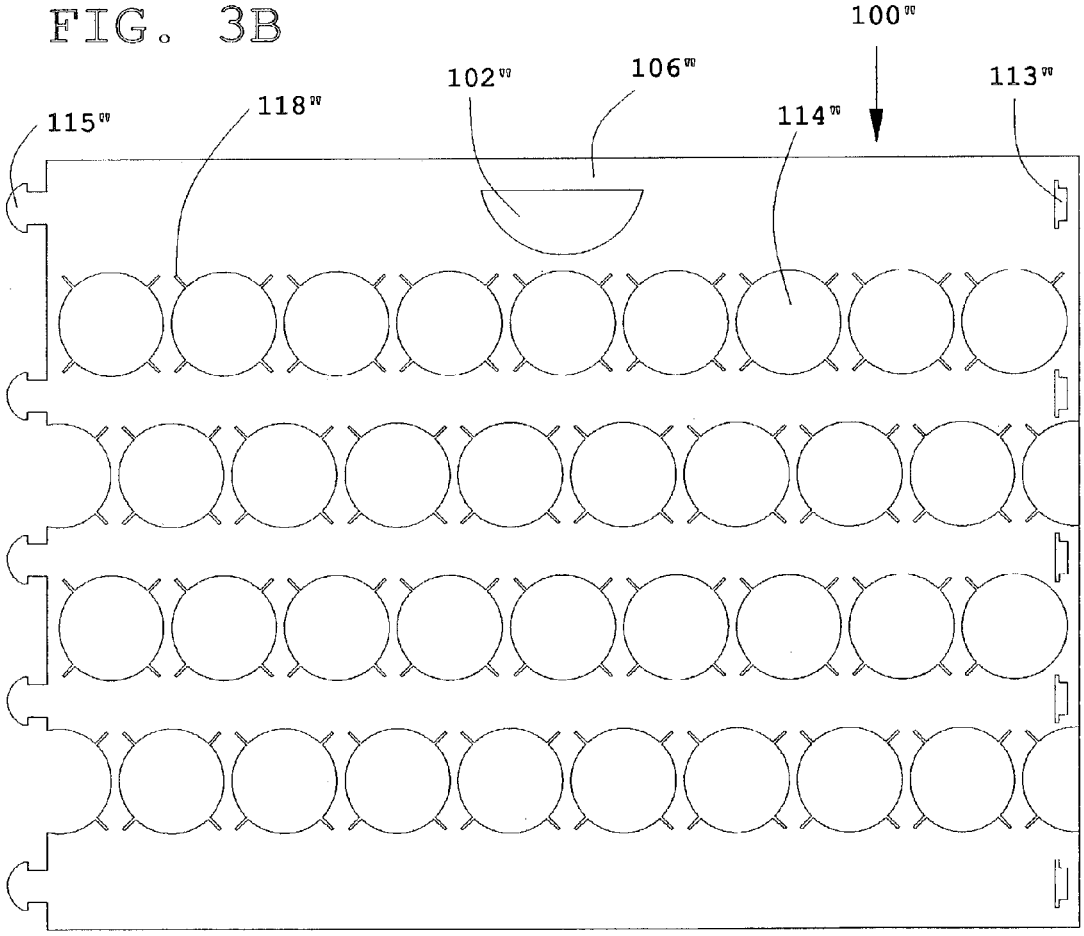
FIG. 3B is a side view showing another embodiment of the Light String Storage device constructed for multiple strands and which is in an unassembled flat state.

FIGS. 3A and 3B show devices 10" and 100", respectively. Here, the devices 10" and 100" are made from a flat sheet 12" of material, such as plastic which is able to be formed into a tubular member. The sheet 12" includes tab receiving slots 13" formed in one end and fastening tabs 15" which extend from another end of the sheet 12", in addition to open surfaces 14" and wire receiving slots 18". These enable the device 10" to be formed and maintained into a tubular shape. The device 100" includes like formed tab receiving slots 113", tabs 115", open surfaces 114", wire receiving slots 118", open surface 102" and handle portion 106".

Figure 5B:
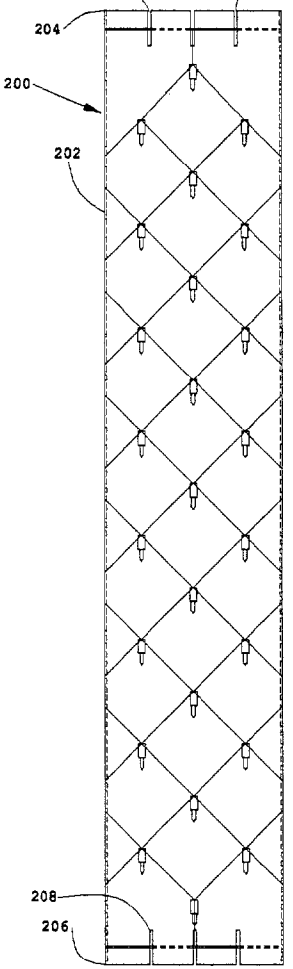
FIG. 5B is a side view of an embodiment of the Light String Storage device of the invention with the net light set thereon.
Figure 5A:
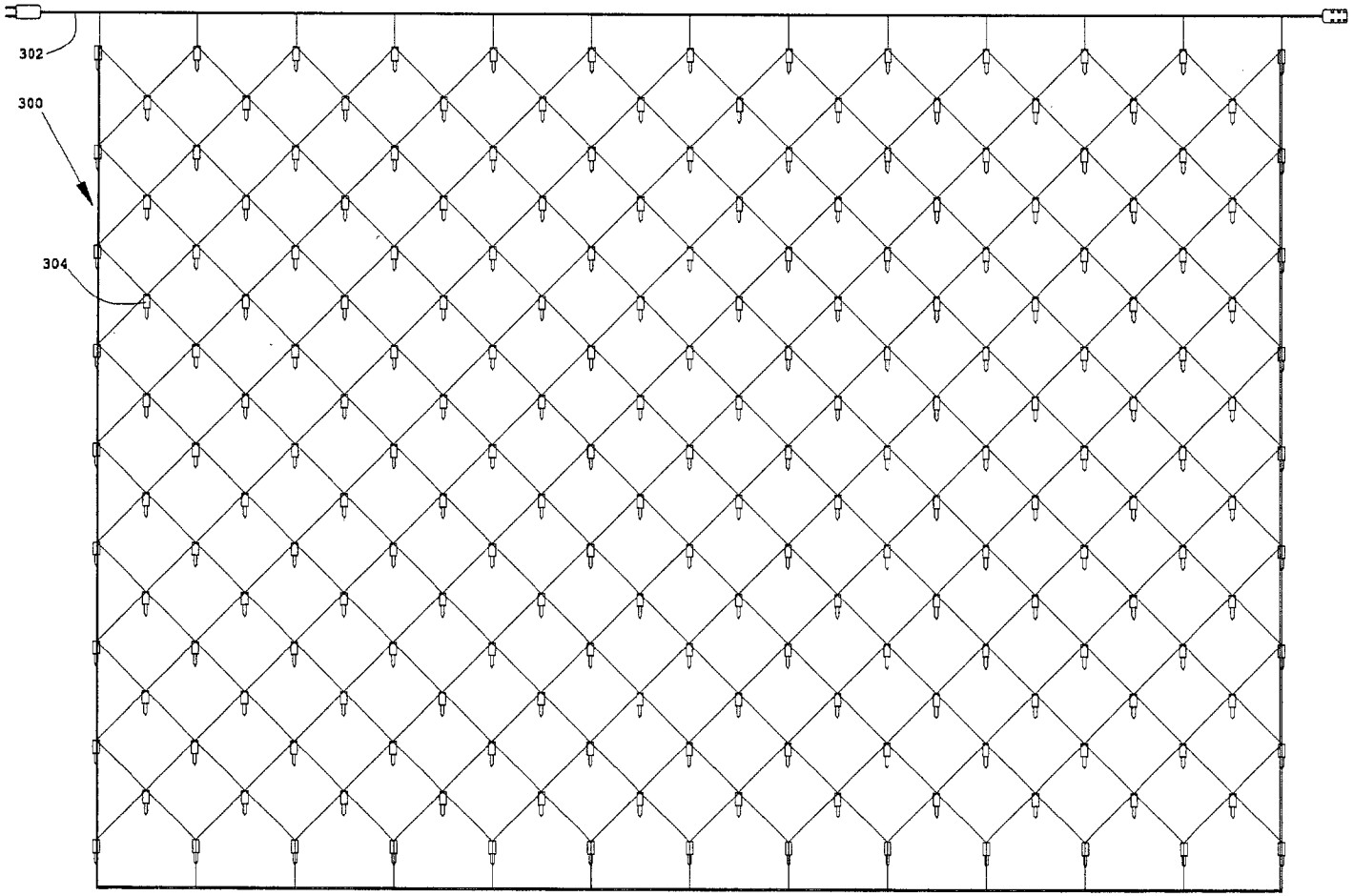
FIG. 5A is a side view of a net light set.

FIG. 5A depicts a net light set 300 having a wire 302 which operably connects to all of the lights 304 and is shown here in an open rectangular state with the wire 302 extending around the perimeter of the rectangle. The device 200 shown in FIG. 5B includes a tubular member 202, here having a plurality of circumferentially spaced wire receiving slots 208 on each end 204 and 206. The tubular member 202 is preferably designed to be of slightly longer length substantially than of a side length of the rectangular net light set 300. Opposing sides of the net permit the wire 302 to be friction fit between the opposing slots 208. Once initially secured, the net 300 can be wrapped around the tubular member 202 until reaching the end of the net, then opposing sides of the net 300 can likewise be secured to the tubular member 202 by fixing wire 302 to one of the slots 218.

Figure 6A:
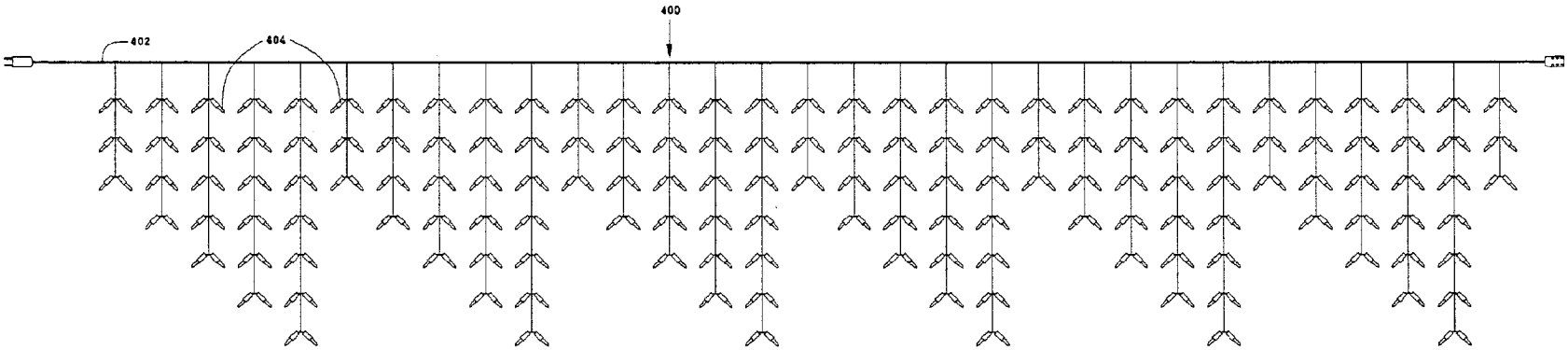
FIG. 6A is a side view of a curtain and icicle light set.
Figure 6B:
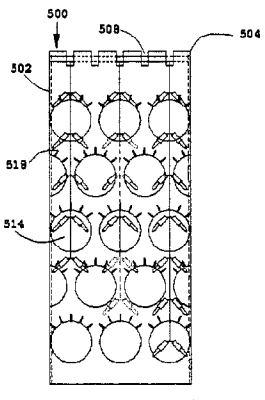
FIG. 6B is a side view of an embodiment of the Light String Storage device of the invention with the curtain and icicle light set thereon.

Still another embodiment is shown in FIG. 6B. FIG. 6A depicts a curtain and icicle light set 400 having a wire 402 which operably connects to all of the lights 404 and is shown here in an open staggered state of strands with the wire 402 extending lengthwise along the top with the lights 404 hanging downwardly therefrom. The device 500 shown in FIG. 6B includes a tubular member 502, here having a plurality of circumferentially spaced wire receiving slots 508 on an end 504. The tubular member 502 is preferably designed to be of a length substantially that of a length of a longest strand in set 400. The wire 402 can be friction fit into one of the slots 508. Once initially secured, the set 400 can be wrapped around the tubular member 502 until reaching the end of the net, then the terminal end of the wire 402 the net 400 can likewise be secured to the tubular member 502 by fixing wire 402 to one of the slots 508. Further, the tubular member 502 has like open surfaces 514 and wire receiving slots 518 so that the lights 404 on the strands can be inserted into a coinciding open surface 514 and/or secured to a slot 518.

Figure 7B:
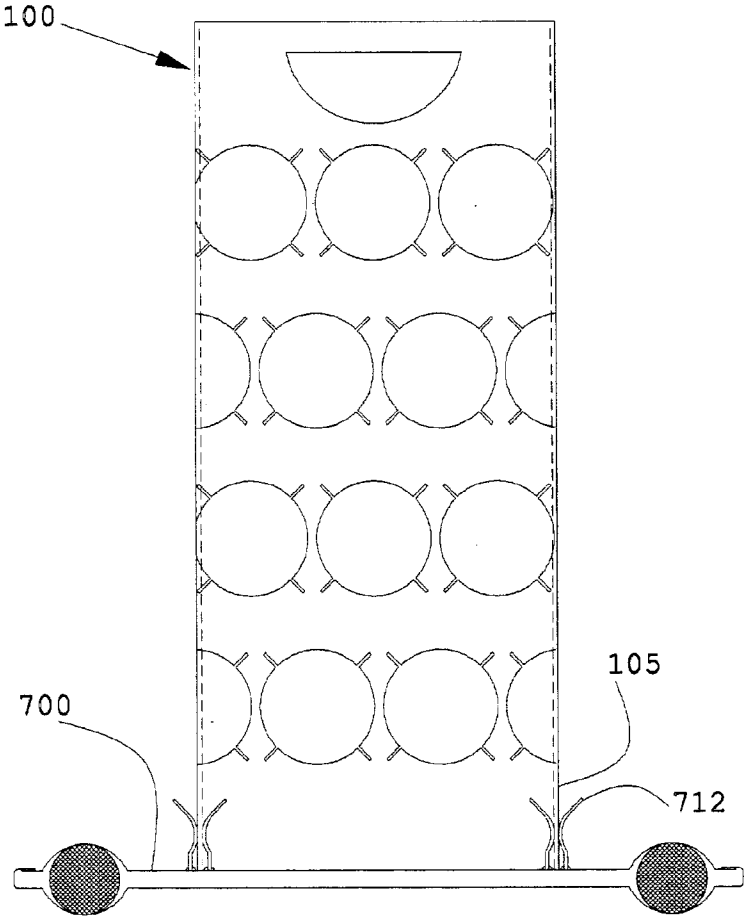
FIG. 7B is a side view showing a turntable with retainer with the light string storage device constructed for a plurality of light strands in accordance with the present invention.
Figure 7A:
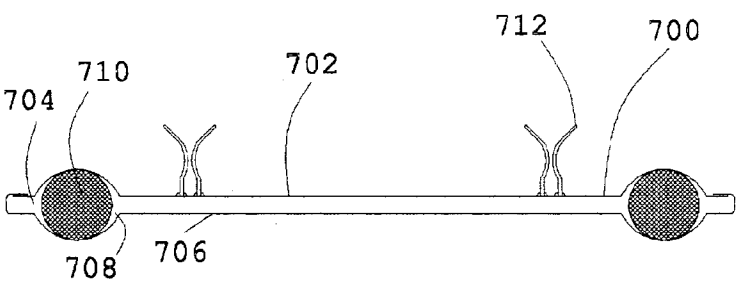
FIG. 7A is a side view showing a turntable with retainer such as a clip.

A further embodiment is shown in FIG. 7A. FIG. 7B shows the turntable 700 for use with device 100, for example. The turntable 700 has a top plate 702 configured with an annular race 704 and a bottom plate 706 having an annular race 708. The top plate 702 and bottom plate 706 are mated such that the races 704 and 708 are in opposing relation and have ball bearings 710 operably retained therebetween, wherein the plates 702 and 706 are movably connected to one another. Extending upwardly from the top surface 702 are retainer clips 712 connected thereto. The clips 712 frictionally retain a bottom end 105 of the device 100.

A few of the Light sets that can be used with this device include (but are not limited to) the following: standard C-9, C-7 & C-6 Single Strand Light Sets, Double Lights & Mini Light Sets, Net Light Sets, Icicle Style Light Sets, Swag-Style Light Sets, Curtain & Twin Curtain light Sets, Crystallized Rope light. etc. The present invention provides for a free standing light storage device, made out of pipe or flat stock material, wherein multiple strands can be held with protection of the bulbs and offers the minimal tangling of the wires. This storage device can be used as a free-standing rack or be hand held.

The storage device can be stacked leaving if sold as a one piece assembled pipe to allow for the most product in the least amount of selling space, or sold flat for later assembly. The storage device can accommodate the many different kinds of light strands, varied bulb sizes and distances between bulbs, as well as, the various lengths of electrical wire and it can be used for multiple strings of lights. The device further includes assembly without tools, few moving parts with the least amount of effort to assemble or instruction, made in a stackable or flat state for easy packaging, shipping and transporting and is lightweight.

The above described embodiments are set forth by way of example and are not for the purpose of limiting the present invention. It will be readily apparent to those skilled in the art that obvious modifications, derivations and variations can be made to the embodiment without departing from the scope of the invention. Accordingly, the claims appended hereto should be read in their full scope including any such modifications, derivations and variations.

What is claimed is:

1. A Christmas light storage device for storing a plurality of lights and connected to a plurality of sockets which are connected to an electrical wire, wherein the sockets are in a predetermined spaced pattern, which comprises:

a tubular member having a plurality of open surfaces circumferentially spaced about the tubular member in a manner to receive one of the lights and sockets as the wire is wrapped about said tubular member and each open surface includes a radially extending wire receiving slot which is of a size to receive the wire in a friction fit manner.

2. The Christmas light storage device of claim 1, which is further characterized to include a first set of said open surfaces in a generally linear array radially about said tubular member.

3. The Christmas light storage device of claim 1, which is further characterized to include a second set of said open surfaces axially displaced from said first set and in a generally linear array radially about said tubular member.

4. The Christmas light storage device of claim 1, which further includes a handle open surface formed at one end of said tubular member such that a portion of said end adjacent said handle open surface forms a handle in which to carry said device.

5. The Christmas light storage device of claim 1, wherein said tubular member is a frustoconical.

6. The Christmas tight storage device of claim 1, which further includes a plurality of circumferentially spaced wire receiving slots formed in an end of said tubular member which are of a size to receive the wire in a friction fit manner.

7. The Christmas light storage device of claim 1, wherein said open surfaces include a plurality of said slots.

8. The Christmas light storage device of claim 6, wherein said open surfaces include a plurality of said slots.

9. The Christmas light storage device of claim 1, wherein said tubular member is formed by connectable mating two ends of a flexible sheet of material.

10. The Christmas light storage device of claim 1, which further includes a turntable connectable to said tubular member.

11. The Christmas light storage device of claim 10, wherein said turntable is removably connectable to tubular member.

* * * * *